United States Patent [19]

Locke

[11] Patent Number: 4,534,504

[45] Date of Patent: Aug. 13, 1985

[54] UNITARY CELLULAR PARTITION FOR CONTAINERS

[75] Inventor: Frank W. Locke, Minneapolis, Minn.

[73] Assignee: Champion International Corporation, Stamford, Conn.

[21] Appl. No.: 592,891

[22] Filed: Mar. 23, 1984

[51] Int. Cl.[3] ..... B65D 5/48

[52] U.S. Cl. ..... 229/15; 229/27

[58] Field of Search ..... 229/15, 27, 28 R, 42

[56] References Cited

U.S. PATENT DOCUMENTS

| | | | |
|---|---|---|---|
| 2,704,865 | 3/1955 | Siering | 229/42 X |
| 2,830,749 | 4/1958 | Lauritzen | 229/15 |
| 3,187,981 | 6/1965 | Farquhar et al. | 229/42 |
| 3,327,919 | 6/1967 | Kim | 229/42 X |
| 3,640,445 | 2/1972 | Durham | 229/15 |
| 3,738,561 | 6/1973 | Nederveld | 229/15 |

*Primary Examiner*—William Price
*Assistant Examiner*—Gary E. Elkins
*Attorney, Agent, or Firm*—Evelyn M. Sommer

[57] ABSTRACT

A partition for utilization in a container to provide appropriate support for bottles, jugs or containers which may be fragile, wherein the partition is formed from a single planar blank having a central opening and a first pair of partition walls foldably connected to each other on one side of the opening. A second pair of partition walls are foldably connected to each other on the other side of the opening. The opening is partially bounded by parallel longitudinal edges of the opening, with each of these opening edges being provided by aligned edges of a pair of the partitions. The blank is foldable, with the partition walls being folded back on the order of 90° with respect to each other as the said walls are folded toward each other so that the fold line connections between the two sets of walls meet and the partitions extend at angles to each other. The partition structure, when inserted into a container, provides partition walls which do not readily rotate with respect to each other and therefore do not interfere with automatic loading devices. The opening in the blank between the walls is provided with extensions into the opening and extensions exterior of the partition structure to provide a support and base for the partition when it is folded up from the blank and inserted into the container.

6 Claims, 9 Drawing Figures

UNITARY CELLULAR PARTITION FOR CONTAINERS

The present invention relates to partitions for utilization in cartons to protect fragile devices such as jars or bottles made of glass or other breakable material, and more particularly to a partition which is easily erected from a collapsed condition, readily insertable into a container and which will also maintain its shape in the container and thereby facilitate loading of the items into the container.

BACKGROUND OF THE INVENTION

In the manufacture of partitions for insertion into containers, it is usual to provide slotted partition boards in which the slots are spaced to match the positions of slots in transverse boards so that when the boards are placed together with the slots interengaged or interfingered, a cellular structure is formed which will provide appropriate protection for fragile elements or devices inserted into a carton. The process of creating such partitions requires first that the partition boards or slats be interfingered or interengaged with the transverse boards or slats, second that the partition structure which will readily collapse be opened up to the full cellular structure and then inserted into the carton. Where the partition is a multi-cellular partition consisting of more than four cells, then usually the insertion of the partition structure into the carton will maintain its erected form. Where the partition, however, consists of two boards which are interfingered at central slotted positions to form four cells when inserted into the carton, the boards may rotate with respect to each other prior to the insertion of the items into the carton. Thus, it becomes necessary at a carton loading station to have a person present who will ensure that the partitions are fully open to permit automatic loading without interference

BRIEF DESCRIPTION OF THE INVENTION

The present invention is directed to the solution of the problems which have heretofore occurred by providing a partition which is made from a single blank appropriately slotted, cut and scored so that it may be erected into a multi-cellular partition by a single manipulative operation. Also, the present invention is directed to a structure which, when erected into partition form and placed within a carton, will maintain the cellular form and not accidentally or inadvertently permit any one of the partitioned walls to move to interfere with automatic loading into the carton.

A primary object of the present invention, therefore, is the arrangement of a partiton for a carton wherein the partition is formed from a single web or sheet which is appropriately cut and scored so that when folded up along the score lines, a four-cell partition will be created.

A further object of the present invention is the provision of a partition structure which, when the partition structure is inserted into a carton to create a plurality of cells, the partition wall will be fixed against rotation with respect to an adjacent partition wall, thereby maintaining the integrity of the cellular structure and thereby also ensuring that any further automatic operations which require a fully erected partition in the carton may proceed without the assistance or intervention of any individual who might otherwise have been required to hold the partition walls in position.

BRIEF DESCRIPTION OF THE DRAWINGS

The foregoing and many other objects of the present invention will become apparent from the following description and drawings in which.

DETAILED DESCRIPTION OF THE DRAWINGS

Figure 1:
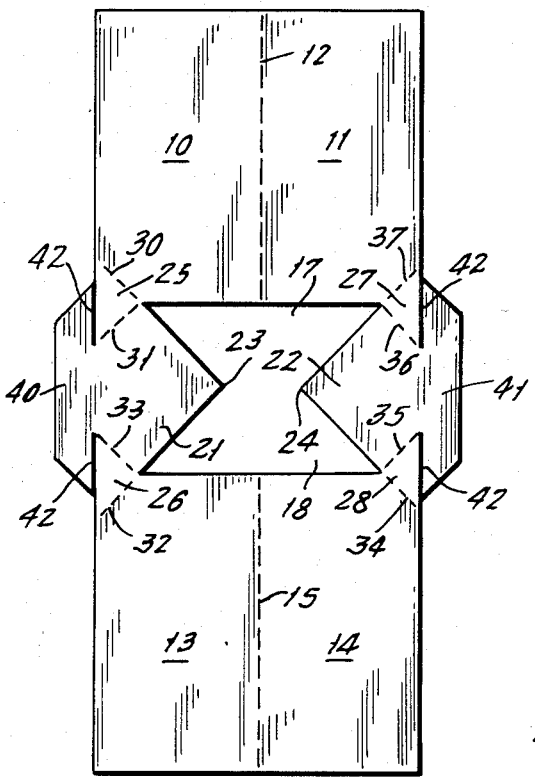
FIG. 1 is a plan view of the blank from which the partition of the present invention is formed.

Referring to the drawings, it should be understood that the essence of the present invention is the construction of the partition of a single piece of board arranged in such a way that in one motion it can be formed into a cross configuration that will remain in proper orientation within the box so that it will not interfere with the loading of the bottles, jugs or containers and provide a separation pad between all of the bottles.

In FIG. 1, the blank from which the partition of the present invention is formed is shown as a single planar structure consisting of a first pair of partition walls 10, 11 interconnected by the fold line 12 and a second pair of partition walls 13, 14 interconnected by the fold line 15. The center of the planar structure of FIG. 1 is cut out at 17, 18 into the double trapezoid form having the inwardly directed substantially triangular section 21 and the inwardly directed substantially triangular section 22. The apices 23 and 24 of section 21 and 22 extend into the areas 17, 18. The triangular section 21 is connected to the panels 10, 13 and the section 22 is connected to panels 11, 14. These connections are made by the triangular gores 25, 26 on one side and 27, 28 on the other side. Each of the gores 25, 26, 27, 28 is bounded by two fold lines. Gore 25 is connected on one side by the fold line 30 to the panel wall 10 and by the fold line 31 to the triangular section 21. Similarly, gore 26 is connected by the fold line 32 to the panel section 13 and by the fold line 33 to the triangular section 21, gore 28 is connected by the fold line 34 to the panel 14 and by the fold line 35 to the triangular section 22, and gore 27 is connected by the fold line 36 to the triangular section 22 and by the fold line 37 to the partition panel 11.

Extending out integrally from the bases of the triangular sections 21, 22 are the platform extension 40, 41 which are here shown in trapezoidal form, although they may take other outer boundary forms consistent with the width of the initial web. Sections 40, 41 are separated from the gores 25, 26, 27, 28 by the slits 42 so that the said gores may fold as hereinafter described. The sections 40, 41 serve as shown particularly in FIGS. 4, 8 and 9 as additional supports to ensure that the partition structure, when erected, is appropriately centered in the container.

Figure 2:
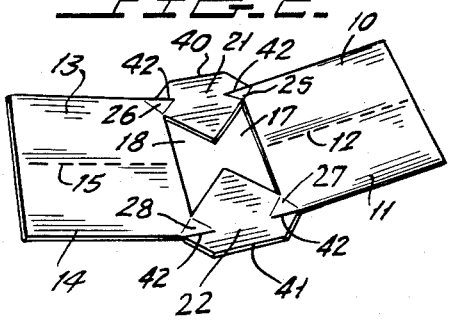
FIG. 2 is a view in perspective, showing the manner in which the blank of FIG. 1 is initially started on the folding operation to form the final partition structure.
Figure 3:
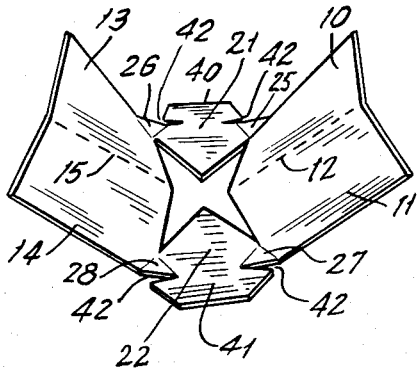
FIG. 3 is a view in perspective corresponding to that of FIG. 2, showing a further step in the operation of forming the partition from the blank of FIG. 1.
Figure 4:
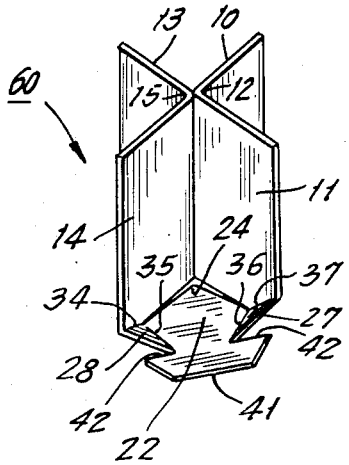
FIG. 4 is a view in perspective of the partition as formed by the operation of the steps of FIGS. 2 and 3 from the blank of FIG. 1 to the partition structure of FIG. 4.

In operation, when it is desired to insert a partition into the container 50, which has already been erected, the panels 10, 11 are grasped at their outer ends adjacent the fold line 12 by one hand and the panels 13, 14 are grasped adjacent their outer ends at the fold line 15 and each of the said panels is folded up simultaneously through the positions of FIGS. 2 and 3 to the position of FIG. 4.

In this folding operation, with the heel of the left hand engaging the panel wall 10 and the thumb of the left hand engaging the panel wall 11 and the heel of the right hand engaging the panel wall 13 and the thumb of the right hand engaging the panel wall 14 serve, as both hands move the panel walls 10, 13, 14, 41 around the hinges formed by the fold lines 31, 33, 35, 36, both to bend the walls as a whole upwardly toward each other and at the same time to back bend the panels 10, 11 with respect to each other, as well as the panels 13, 14 with respect to each other through the position of FIG. 3 to the erected position of FIG. 4.

Figure 5:
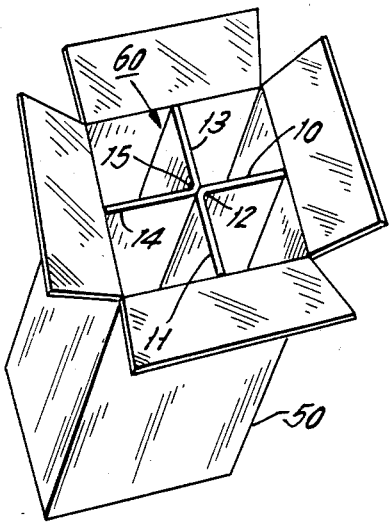
FIG. 5 is a view in perspective showing the insertion of the partition of FIG. 4 into the container.

When the erected position of FIG. 4 is reached, the completed partition 60 is inserted in the container 50, as shown in FIG. 5, with the panel walls 10 and 11 at right angles to each other, the panel walls 13 and 14 at right angles to each other and the respective fold lines 12 and 15 meeting along the vertical axis.

When the erected partition structure is now inserted into the container of FIG. 5, the erected partition structure is held in its erected position and the walls 10, 11, 13 and 14 will not rotate with respect to each other to interfere with automatic loading.

Figure 8:
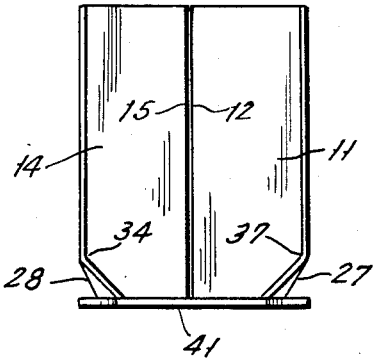
FIG. 8 is a view taken from line 8—8 of FIG. 6, looking in the direction of the arrows, showing the partition of FIG. 4 as completed and ready for insertion into the container structure as shown in FIG. 5.
Figure 9:
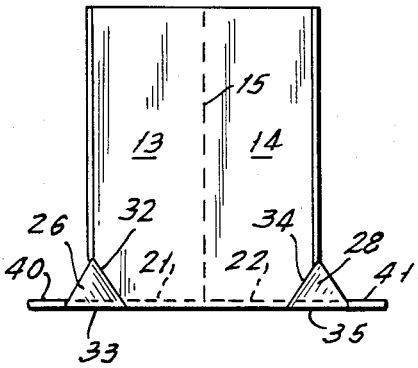
FIG. 9 is a view corresponding to FIG. 8 but taken on line 9—9 of FIG. 6 looking in the direction of the arrows and showing another elevation of the partition of FIG. 4 inserted into the container of FIG. 5.
Figure 6:
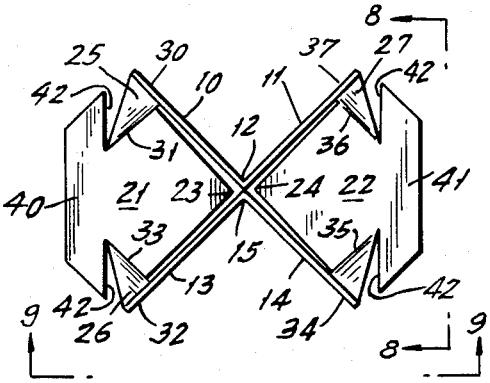
FIG. 6 is a top plan view of the folded partition of FIG. 4.
Figure 7:
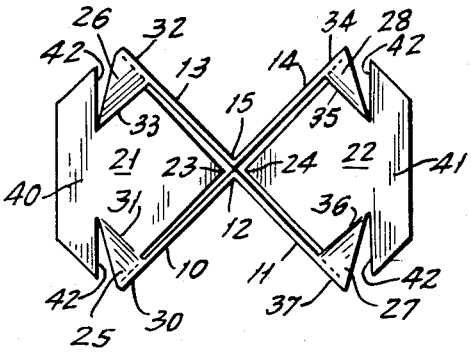
FIG. 7 is a bottom plan view of the folded partition of FIG. 4.

FIGS. 6 and 7 are top and bottom plan views of the partition structure of FIGS. 8 and 9 and FIGS. 8 and 9 are elevational views from two angles, at 90° from each other, of the erected partition as it is inserted into the container and thus have the same reference numbers as those already described in connection with the partition.

It will thus be seen that the partition may readily be erected by a single movement of two hands grasping opposite ends thereof to form the partition 60 from a single planar web and on insertion into the container, the partition arrangement is such that the kind of swinging of partition walls with respect to each other which would occur in the case of a slotted four cell partition simply does not occur. Thus, automatic loading is made possible without the necessity for the intervention of a person adjacent the loading area to make sure that the partitions are at a full 90° to each other so as not to interfere with the loading operation.

By this means, therefore, instead of having a plurality of slotted elements which must be interfingered or interengaged and which may hinge readily with respect to each other once they are interengaged, a single unitary structure is provided for forming the multi-cellular partition. Also, by avoiding the need for utilization of a multiplicity of slats or partition elements and by utilizing a single web which is folded up, the hinging or swinging of the partition walls with respect to each other after the partition is assembled and inserted into the container is obviated. The partition walls therefore remain in a preset condition and thus permit ready and automatic access to the partition element.

In the foregoing, the present invention has been described in connection with a preferred illustrative embodiment thereof. Since many variations and modifications of the present invention will now be obvious to those skilled in the art, it is preferred that the scope of the present invention be determined not by the specific disclosures contained herein, but only by the appended claims.

What is claimed is:

1. A cellular partition structure formed from a planar blank for erection and insertion into a rectilinear container comprising:

first and second partition walls constituting a first pair of partition walls hingedly connected to each other by a fold line constituting a hinged connection and third and fourth partition walls constituting a second pair of partition walls hingedly connected to each other by a fold line constituting a hinged connection, each pair of partition walls having an upper end and a lower end;

a first and a second connecting section constituting a pair of opposite longitudinal connecting sections which are between and join said lower ends of each pair of partition walls with said first connecting section joining said first and third partition walls and said second connecting section joining said second and fourth partition walls;

wherein said partition has an open-ended upper section adapted to receive a fragile device and a lower section to support the partition structure and prevent its rotation in the container, the lower section of the partition being defined by an opening in the blank at the lower end of each pair of connected partition walls and said opposite longitudinal connecting sections, which connecting sections are along each side of said opening, the lower ends of said fold lines of said pairs of partition walls touching said opening;

said pairs of walls being initially spaced from each other in the blank on opposite sides of said opening, each said connecting section including means for folding said pairs of walls toward each other;

each pair of walls, when folded toward the other pair of walls, being bent angularly around the respective fold lines to form a substantial angle with the adjacent partition wall of the pair when the fold lines meet; said fold lines meeting along a single axis along the center of said container to form a four-celled partition.

2. The partition structure of claim 1 wherein said opening has a double trapezoid shape.

3. The partition structure of claim 1 wherein said opening is provided with a pair of inwardly extending panels each extending inwardly from the opposite longitudinal connecting sections between the pairs of partition walls, said inwardly extending panels forming a base for the partition structure.

4. The partition structure of claim 3, wherein the inwardly extending panels are each substantially triangular.

5. The partition structure of claim 4, wherein extension supports are provided at said opposite longitudinal connecting sections extending outwardly from said inwardly extending panels and forming a stabilizing platform for said partition.

6. The partition structure of claim 5, wherein, as portions of said longitudinal connections, said means includes gore-shaped panels provided between the inwardly extending triangular panels and the extension supports.

* * * * *